US007539548B2

(12) United States Patent
Dhawan

(10) Patent No.: US 7,539,548 B2
(45) Date of Patent: May 26, 2009

(54) SMART-CONTROL PLC BASED TOUCH SCREEN DRIVEN REMOTE CONTROL PANEL FOR BOP CONTROL UNIT

(75) Inventor: Samir Dhawan, Uttranchal (IN)

(73) Assignee: Sara Services & Engineers (PVT) Ltd., Dehradun, Uttranchal (IN)

( * ) Notice: Subject to any disclaimer, the term of this patent is extended or adjusted under 35 U.S.C. 154(b) by 0 days.

(21) Appl. No.: 11/359,764

(22) Filed: Feb. 22, 2006

(65) Prior Publication Data

US 2006/0212134 A1 Sep. 21, 2006

(30) Foreign Application Priority Data

Feb. 24, 2005 (IN) ..... 406/DEL/2005

(51) Int. Cl.

| | |
|---|---|
| ***G05B 15/02*** | (2006.01) |
| ***G05B 19/18*** | (2006.01) |
| ***G05B 11/01*** | (2006.01) |
| ***G05D 7/00*** | (2006.01) |
| ***G05D 16/00*** | (2006.01) |
| ***E21B 44/00*** | (2006.01) |
| ***E21B 47/18*** | (2006.01) |
| ***E21B 17/10*** | (2006.01) |
| ***E21B 43/12*** | (2006.01) |

(52) U.S. Cl. ..... 700/19; 700/9; 700/20; 700/282; 700/301; 175/24; 175/25; 175/40; 175/230; 166/53; 166/250.15

(58) Field of Classification Search ..... 700/17, 700/83, 9, 19–20, 282, 301; 73/152.01; 702/6; 340/853.1, 870.03; 166/338, 53, 250.15; 175/24–25, 40, 230

See application file for complete search history.

(56) References Cited

U.S. PATENT DOCUMENTS

| | | | | |
|---|---|---|---|---|
| 3,865,142 | A * | 2/1975 | Begun et al. | 137/635 |
| 4,337,653 | A * | 7/1982 | Chauffe | 73/152.43 |
| 4,507,735 | A * | 3/1985 | Moorehead et al. | 702/9 |
| 4,636,934 | A * | 1/1987 | Schwendemann et al. | 700/3 |
| 4,924,949 | A * | 5/1990 | Curlett | 175/25 |

(Continued)

OTHER PUBLICATIONS

Printout from Schlumberger website: definition and graphical depiction of a blowout preventer; 2 pages.*

(Continued)

*Primary Examiner*—Ronald D Hartman, Jr.
(74) *Attorney, Agent, or Firm*—Ladas & Parry LLP

(57) ABSTRACT

The present invention relates to a device for controlling the Blow out preventer (BOP) used in well drilling operations comprising: BOP control unit, master control panel connected to the BOP unit for acquisition of data and processing the said data, comprising an input module, an output module and analog I/P module; a plurality of slave panels connected to master panel through the connecting means comprising input module, output module for controlling the BOP control unit; wherein the said slave panel is a programmable logic controller(PLC) for controlling BOP control unit.

20 Claims, 3 Drawing Sheets

U.S. PATENT DOCUMENTS

| | | | | |
|---|---|---|---|---|
| 5,868,201 | A * | 2/1999 | Bussear et al. | 166/53 |
| 6,029,951 | A * | 2/2000 | Guggari | 254/269 |
| 6,032,742 | A * | 3/2000 | Tomlin et al. | 166/345 |
| 6,102,673 | A * | 8/2000 | Mott et al. | 417/392 |
| 6,305,471 | B1 * | 10/2001 | Milloy | 166/250.15 |
| 6,422,315 | B1 * | 7/2002 | Dean | 166/339 |
| 6,513,606 | B1 * | 2/2003 | Krueger | 175/61 |
| 6,728,638 | B2 * | 4/2004 | Newman | 702/5 |
| 6,801,135 | B2 * | 10/2004 | Schultz et al. | 340/853.1 |
| 6,896,055 | B2 * | 5/2005 | Koithan | 166/250.15 |
| 6,968,905 | B2 * | 11/2005 | Adnan et al. | 166/384 |
| 7,080,544 | B2 * | 7/2006 | Stepanik et al. | 73/31.02 |
| 7,123,162 | B2 * | 10/2006 | Mackenzie et al. | 340/854.7 |
| 2002/0018399 | A1 * | 2/2002 | Schultz et al. | 367/81 |
| 2002/0080938 | A1 * | 6/2002 | Alexander et al. | 379/106.01 |
| 2002/0169645 | A1 * | 11/2002 | Aronstam et al. | 705/7 |
| 2003/0006070 | A1 * | 1/2003 | Dean | 175/5 |
| 2004/0154832 | A1 * | 8/2004 | Koithan | 175/26 |
| 2004/0156264 | A1 * | 8/2004 | Gardner et al. | 367/81 |
| 2004/0168811 | A1 * | 9/2004 | Shaw et al. | 166/368 |
| 2004/0182574 | A1 * | 9/2004 | Adnan et al. | 166/250.01 |
| 2005/0092523 | A1 * | 5/2005 | McCaskill et al. | 175/38 |
| 2005/0222772 | A1 * | 10/2005 | Koederitz et al. | 702/6 |
| 2006/0175090 | A1 * | 8/2006 | Reitsma et al. | 175/25 |

OTHER PUBLICATIONS

Wayback Machine; 1 page.*
Accumulator Units; from Sara-Sae Website; 3 pages.*
PLC-Intro; 16 pages.*
The New Drilling Control and Monitoring System; 7 pages.*
Wayback Machine; 1 page ; Apr. 16, 2008.*
Accumulator Units; from Sara-Sae Website; 3 pages ; as shown to the public on Aug. 10, 2004; printout of search results was created on Apr. 16, 2008.*
The New Drilling Control and Monitoring System; 7 pages ; Sep. 2002.*
Oil and Jas Journal; 4 pages ; Sep. 16, 2002.*

* cited by examiner

SMART-CONTROL PLC BASED TOUCH SCREEN DRIVEN REMOTE CONTROL PANEL FOR BOP CONTROL UNIT

FIELD OF THE INVENTION

The present invention relates to a programmable logic controller (PLC) based touch screen driven remote control panel for blowout preventer (BOP) control unit and more particular to a system for coupling a network of programmable controller through an inter networking to a monitoring and controlling blowout prevention control unit (BOP Control Unit)

BACKGROUND OF THE INVENTION

BOP Control units have been in existence for many years, and are generally employed in the oil and gas industry to control blow out preventer. These are safety equipments. These units are operated from the unit as well as remote control panels. These panels allow complete control and pressure monitoring of the BOP control system from Drill floor or any other alternative place. These panels enable the BOP control manifold to be placed in a safe area so that it can remain operational in emergency condition. Presently the panels systems being used are operated either by air or arc electrical.

PRIOR ART

U.S. Pat. No. 4,295,529, WILLIAM N STRICKLAND teaches a blowout preventer for attachment to the drill stem and being placed within the drill casing during well operations provides a bottom seal assembly having an attachment for slideably attaching the bottom seal assembly peripherally to a section of drill stem with the bottom seal assembly having at least one flow opening allowing oil, gas and drilling fluids to pass therearound. The upper portion of the bottom seal assembly forms a valve which cooperates with a provided port-ring mounted above the bottom seal assembly and having an outer diameter substantially equal to the diameter of the casing.

U.S. Pat. No. 3,724,541, Curry B. David teaches for use in a well where production is sustained through gas lift methods, an apparatus which shuts in the well on catastrophic failure. The apparatus includes a set of spaced, slidably mounted pistons carried on the production tubing string. Openings in the pistons permit gas flow down through the pistons. When gas flow is upward in the annulus, the lower piston is lifted upwardly and contacts the centrally located piston. The pair slide upwardly against the topmost piston, which is fixedly mounted. When pressed together, the openings through the pistons do not permit continued gas flow in the annulus. This closes the annulus to gas flow.

U.S. Pat. No. 5,276,811, C. Scott Zifferer teaches a software package for developing ladder logic programs for Programmable Logic Controllers(PLCs). This teaches a method of troubleshooting ladder logic programs for a programmable logic controller. The ladder logic program is debugged using an emulator executing on a computer. The emulator executes a second ladder logic program. The second ladder logic program generates the inputs that drive the ladder logic program being debugged. The second ladder logic program is comprised of output instructions that drive input instructions in ladder logic program being debugged. Thus, the emulator simulates the operation of the programmable logic controller.

These known panels had some limitations, which were as follows:-

- Cable laying on offshore rigs was too difficult.
- If an installed system needed an enhancement-fresh cables and hoses were required.
- Response time in air operated panel was too much i.e the system actuated only after filling of air.
- The electrical system had a problem of interference and communication.
- Fiber optics had a problem of field maintenance.
- Laying of cables in an offshore rig was almost next to impossible.
- There was no system of recording trends.

To overcome the limitations of the conventional communication system a two-way radio link (wireless) or two wire system or fiber optic communications link is often necessary to permit a response to a communication initiated from another location. A control system include a programmable logic controller (PLC) which includes various elements, that are often either sensors for providing inputs to the PLC or relays for receiving output from the PLC each under the control of an element controller and each connected to the PLC over a network for rapid execution.

The PLC may be arranged in a master/slave network. The master/Slave control system includes a master(M) and a plurality of remote slave unit. The master (M) including a master PLC, a data link, and an I/O module and also controls I/O connection points using a program and a communication parameter which are set by a user, and also controls the respective I/O connection points for the remote slave units.

The present invention provides new features that enhance and extend the capability of the conventional system.

OBJECTS & SUMMARY OF THE INVENTION

The present invention serves the needs of the prior art enhancing and extending the capability of the PLC. It also provides a method for communicating a programming command to a controller, such as PLC by sending multiple pages via the cellular network control system. The cellular communications device can collect the data carried by the first data page and issue an acknowledgment receipt of the data carried by that page.

- The present invention further provides exclusive marquee available at the time of reporting. It also gives multicolored reporting graphically and digitally.
- The present invention provides exclusive buttons on touch screen for pressure setting/resetting/customize/real time values etc.
- The present invention also provides reading and writing facility for PLC register.
- The present invention also provides pressure reading gauges (in KPa/Bar) with color for different pressure setting.
- The present invention has excellent feature that is, if there is any power supply failure then automatically trend stores and user has no data loss.
- The present invention also provides the safety feature for hardware failure due to looping, purge, communication or power supply.
- The present invention also provides the GMT time setting.
- The present invention also allows reports in a graphical format.

According to the present invention there is provided a device for controlling the Blow Out preventer (BOP) used in well drilling operations comprising:

BOP control unit master control panel connected to the BOP Control unit for acquisition of data and processing the said data, comprising an input module, an output module and analog I/P module;

A plurality of slave panels connected to master panel through the connecting means comprising input module, output module for controlling the BOP control unit;

wherein the said slave panel is a programmable logic controller(PLC) for controlling BOP control unit.

According to the present invention there is also provided a slave panel, which is rig floor master connected with BOP control unit by proximity & pressure line(Input) and airline (output) and remote panel(slave) with radio link(wire less) or two-wire system or Fiber optic a device for controlling the Blow out preventer

BRIEF DESCRIPTION OF THE DRAWINGS

GENERAL WORKING (REF. FIG. 1-6)

Figure 1:
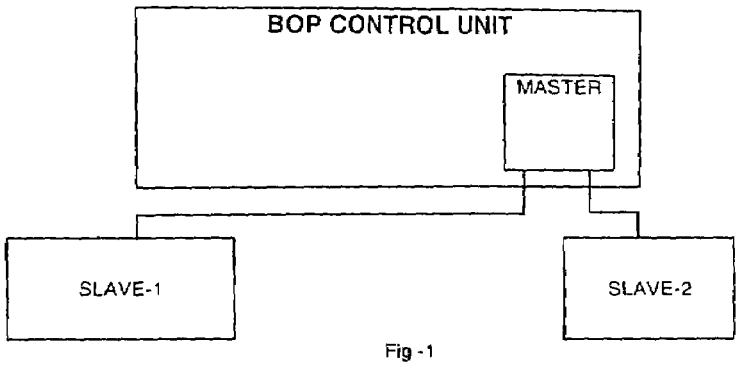
FIG. 1. BOP Control unit having Master panel connected with slave panels.

PLC Panel is a device which can be used to operate BOP Control Unit (accumulator unit). This panel has three parts, one is master which is mounted on BOP control unit and two or more up to 247 slave panel (Remote panel) which is installed at tool pusher office or the driller's site. And Rig floor master is connected with BOP control unit by proximity & pressure line (input) and air line (output) and remote panel with Radio link (wire less) or two wire system or fiber optic.

In case of valve operation first we press push button from any remote panel (Slave) that electrical signal goes to PLC input module after processing in PLC CPU, the Signal goes to master PLC. After reaching the signal in master it will generate the corresponding output to relay. As relay will operate the signal goes to solenoid it will operate the air cylinder (Selector valve) when the valve operated then its position feed back from proximity (which is mounted on selector valve open/close direction) comes in master input module. The master send this feed back to slave PLC it will generate corresponding output and it will be indicated by pilot light.

In case the valve does not operate due to any reason (valve stuck low air pressure) master PLC will generate Alarm signal after 10 Seconds and send to slave PLC where this will pop up on the screen with massage "Function Fail" and Hooter will sound and light blink whenever alarm does not acknowledge.

ANALOG PROCESSING

BOP control unit master panel has four Analog input, three Hydraulic pressures (Annular pressure, Accumulator pressure, and manifold pressure) and one pneumatic pressure (Rig air pressure) these all pressure comes in transducers, the transducer convert these pressure in to 4-20 mA or 0-10 Volts electrical signal. This signal goes to master analog module. Master PLC send this signal to slave PLC which will read the signal and convert it in decimal format and display on screen.

We can set all four pressure on the screen first enter the set value of pressure that value goes to slave it will send this value with running pressure value if this running value is less then to the set value then master PLC will generate alarm signal and sent to slave PLC where this will be popup on the screen with massage "pressure low" and Hooter will sound light blink whenever alarm does not reset.

In case fluid level in the tank has decreased from the set valve, a signal goes to master PLC and is transferred to slave PLC and accordingly alarm starts.

DETAILED DESCRIPTION

A Blowout Preventer(BOP) Control system is a high pressure hydraulic power unit fitted with directional control valves to safely control kicks and prevent blowouts during drilling operations. BOP control unit/Accumulator Unit/Accumulator unit assembly refers to the unitization of the air and electric pump assemblies, hydraulic control manifold and interface assembly onto the accumulator unit module. The primary function of the accumulator unit module is to provide the atmospheric fluid supply for the pumps and storage of the high pressure operating fluid for control of the BOP stack. It includes accumulators, reservoir, accumulator piping and a master skid for mounting of the air operated pumps, electric motor driven pumps and the hydraulic control manifold. Accumulator are ASME (American Society of Mechanical Engineering) coded pressure vessels for storage of high pressure fluid. These accumulators are available in a variety of sizes, types, capacities and pressure ratings. The two basic types are bladder and float which are available in cylindrical styles. The Accumulators can either be bottom or top loading. Top loading means the bladder or float can be removed from the top while it is still mounted on the accumulator unit. Bottom loading accumulators must be removed from the accumulator unit to be serviced. Bladder and bouyant float type accumulators can be repaired in the field without destroying their stamp of approval.

With the concept of improvement it was decided to have an electronic system having wireless modem.

The panel designed has the ability to collect, process, monitor and display the Rig air pressure, accumulator pressure, annular pressure and manifold pressure, Low fluid level, mains fail, low accumulator pressure, low manifold pressure and low rig air pressure, Rams operation and rams position, Function test of rams and Ram operating time & pressure loss.

The BOP control unit has a master control panel which is a data acquisition and processing device from accumulator unit. Its functions are summarized below.

Receives and processes proximity sensor and pressure transducer data and transmits this data to the driller and tool pusher control panel.

Receives and processes data entered by the operator using the display touch screen at the driller and tool pusher control panel.

Powers proximity sensor.

Transmits data to the driller and tool pusher control panel. For historical data display and hard copy printouts.

Configures the system and calibrates sensor, when connected to a laptop.

Proximity sensors are used to measure the position of control valve of accumulator unit. They are powered by from the main PLC cabinet designed to be mounted through the control valve nameplate. It is metal sensitive and produces a signal pulse whenever a metal(i.e disc detent offset of control valve) passes within 10 mm of the sensor head.

Driller and tool pusher panels are intrinsically safe devices that display proximity sensor data, pressure transducer data from the master control panel and control the solenoid valves from the master control panel. The master control panel powers it. Consisting of:

1 Wall mount style air purged (NEMA 4×) stainless steel enclosure with graphic overlay.
2 Push button control stations with indicator lights for BOP functions.
3 Push button control station for bypass function with indicator lights.
4 Alarm light with explosion proof horn for low accumulator pressure, low manifold pressure, low rig air pressure and low fluid level.
5 Increase/decrease station to remotely control annular regulated pressure.
6 It contains a touch screen that enables the operator to view and set pressure and set alarm limits; temporarily silence the alarm horn and functions on and off of control valve. When alarm conditions exist; the panel alerts the operator by activating the attached alarm horn.
7 Pressure data can be presented in KPA or PSI. Display of all pressures is through mimic pressure gauges.

The remote control panel finally designed has following benefits:-

This panel has a digital touch screen display.
It has a cooler for High Temperature conditions.
The unit status and logged alarms are now printable.
It has air and battery backup.
Minimum Rig up time—No air hose—6 core electric cable/fiber optic cables.

Frequency Hopping radios are installed which communicate with a PLC.

FIG. 1 illustrates that Master Panel in BOP control unit connected to slave panels by a two-way radio link (wireless) or two wire system or fiber optic communications link to permit a response to a communication initiated from another location.

Figure 2A:
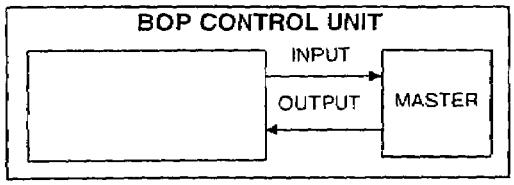
FIGS. 2(*a*) & (*b*). BOP Control unit illustrating the Input/Output communication between Master Panel and rest Parts of BOP Control Unit.
Figure 2B:
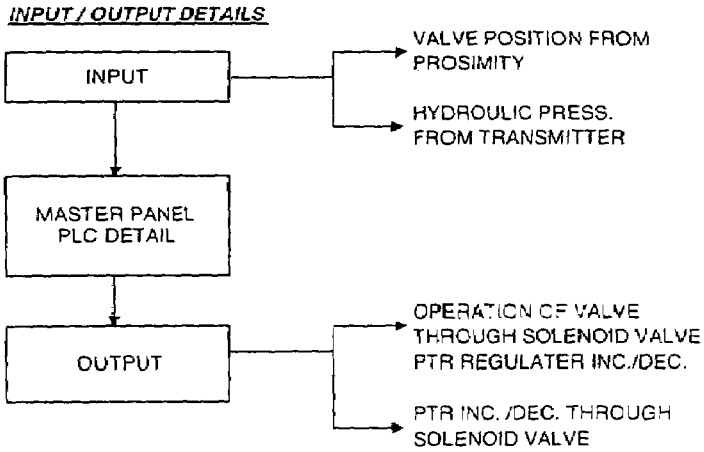

FIG. 2 (*a*) and FIG. 2 (*b*) illustrates Input to the Master Panel are VALVE POSITION from Proximity and Hydraulic Pressure from transmitter. Proximity senses the position of valve from selector valve. There are basically three types of Hydraulic Pressure i.e Accumulator Pressure, Manifold Pressure and Annular Pressure.

Figure 3:
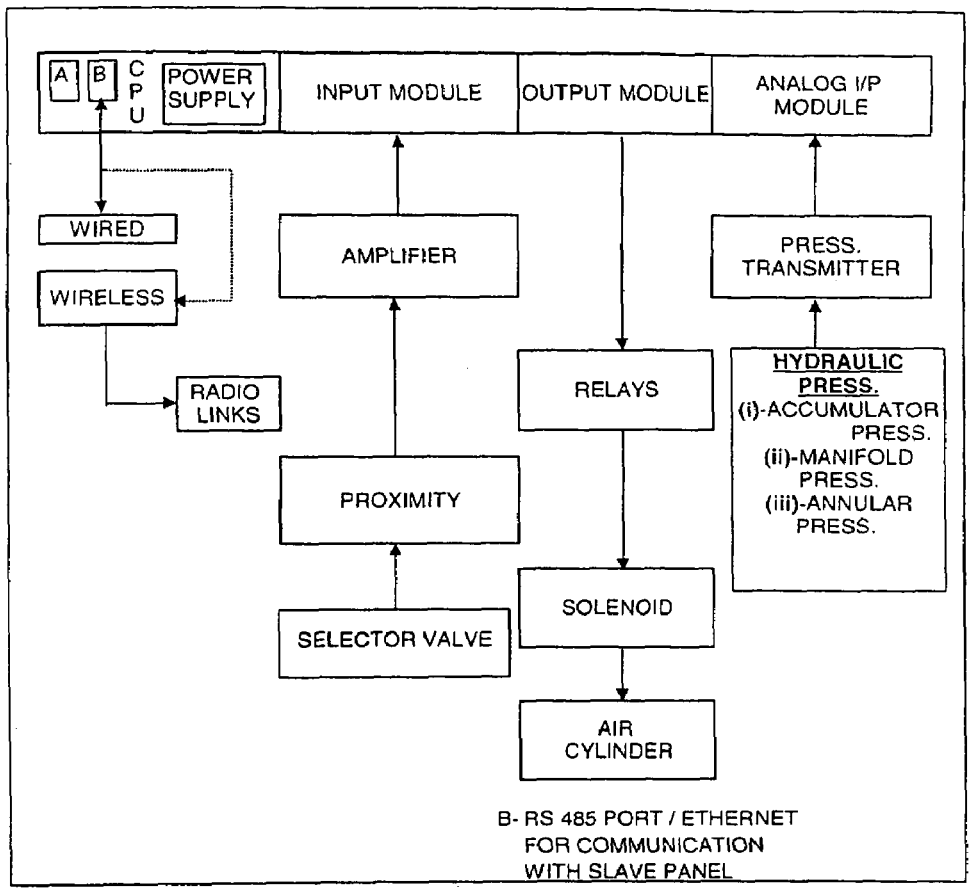
FIG. 3. Master Panel.

FIG. 3 illustrates the systematic arrangement of various parts of master panel in Block Diagram. Figure shows Input Module is placed adjacent to CPU having Power supply and Port A & B, Output Module is placed adjacent to Input Module and Analog I/P Module is placed adjacent to Output Module. However, these elements are internally connected to CPU. Port B, on CPU, for communication with slave panels either wired or wireless, is preferably RS 485 type or Ethernet.

Figure 5:
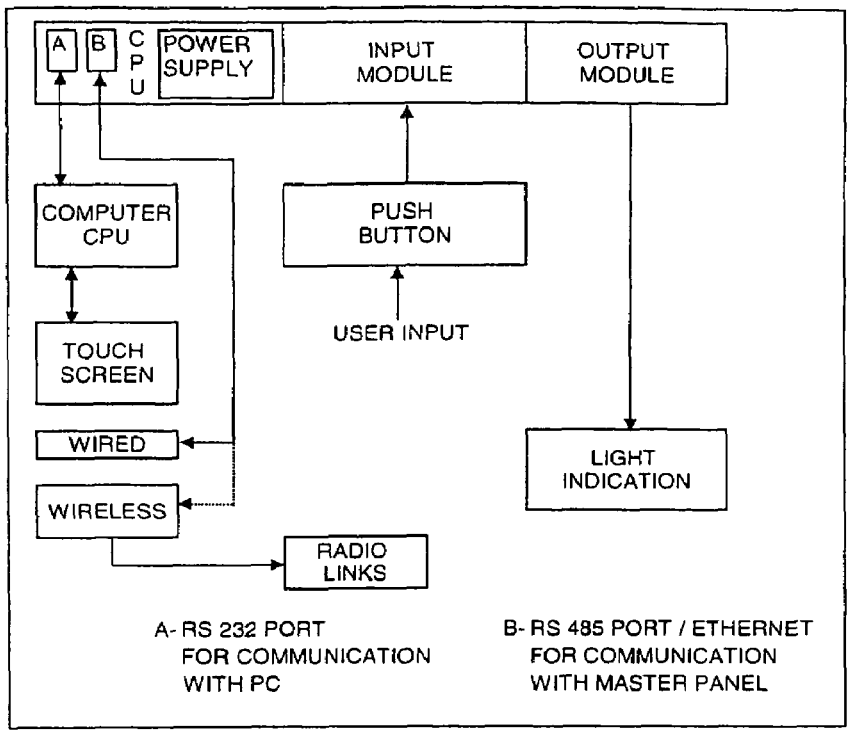
FIG. 5. Slave Panel.

FIG. 5 illustrates the systematic arrangement of various parts of slave panel in Block Diagram. Figure shows Input Module is placed adjacent to CPU having Power supply and Port A & B, and Output Module is placed adjacent to Input Module. However, these elements are internally connected to CPU. Port A on CPU for connecting Computer CPU which in turn connected to touch screen is preferably RS 232 type. Port B on CPU for communication with slave panel either wired or wireless is preferably RS 485 type or Ethernet.

In one embodiment of Master Panel, proximity sensor senses the position of valve from the selector valve and passes signal to amplifier. The Input Module processed the signal received from amplifier for processing, which is further directed to CPU. Master Panel send the processed signal to Slave Panels either via. fiber optics or radio links (wireless). Slave PLC will read the signal and convert it in decimal format and display on screen.

In another embodiment, BOP control unit master panel has four Analog input three Hydraulic pressures (Annular pressure, Accumulator pressure, and manifold pressure) and one pneumatic pressure (Rig air pressure) all these pressure comes in transducers, the transducer convert these pressure in to 4-20 mA or 0-10 Volts electrical signal. This signal goes to master panel analog module. Master panel send this signal to slave PLC which will read the signal and convert it in decimal format and display on screen.

We can set all the four pressure on the screen first enter the set value of pressure that value goes to slave it will send this value with running pressure value if this running value is less then to the set value then master PLC will generate alarm signal and sent to slave PLC where this will be popup on the screen with massage "pressure low" and Hooter will sound light blink whenever alarm does not reset.

In case fluid level in the tank has decreased from the set valve, a signal goes to master panel and transferred to slave PLC and accordingly alarm starts.

In a preferred embodiment of slave panel, when the user need to operate any function of BOP control unit like valve open/close, Increase-decrease of annular pressure etc.

In case of valve operation, first the user press push button from any remote panel (Slave) that electrical signal goes to PLC input module after processing in PLC CPU, the Signal goes to master panel via a radio link or fiber optic. After reaching the signal in master panel it will generate the corresponding output to relay. As relay will operate the signal goes to solenoid it will operate the air cylinder (Selector valve) when the valve operated then its position feed back from proximity (which is mounted on selector valve open/close direction) comes in master panel input module. The master panel send this feed back to slave PLC it will generate corresponding output and it will indicate by pilot light.

In case of valve does not operate due to any reason (valve stuck low air pressure) master panel will generate Alarm signal after 10 seconds and send to slave PLC where this will be popup on the screen with massage "Function Fail" and Hooter will sound and light blink whenever alarm does not acknowledge.

Figure 4:
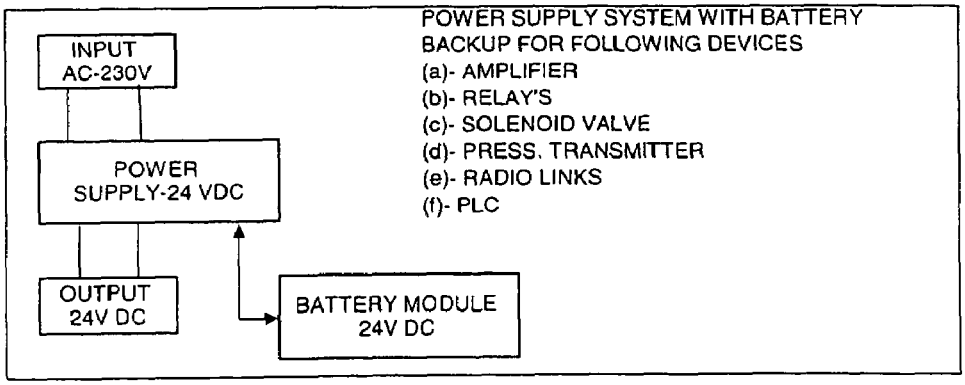
FIG. 4 Power Supply system with Battery Backup for devices in Master Panel.

FIG. 4 illustrates the power supply system in Master Panel with battery backup for amplifier, relays, solenoid valve, pressure transmitter, radio links and PLC.

Figure 6:
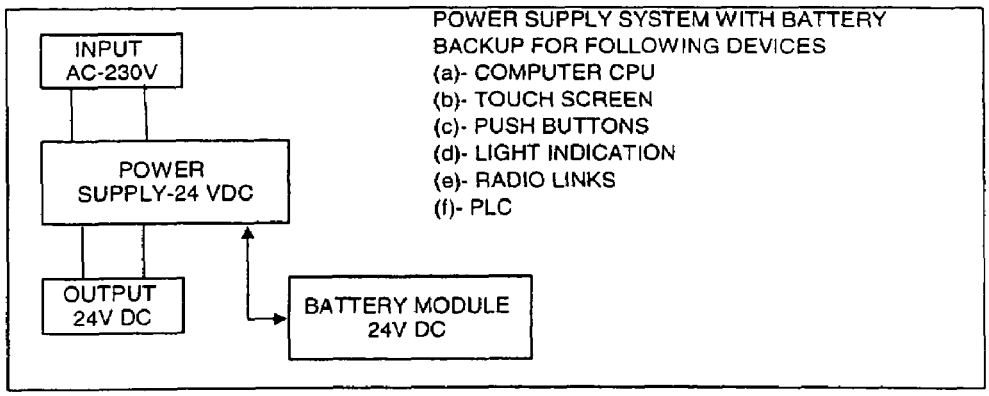
FIG. 6. Power Supply system with Battery Backup for devices in Slave Panel.

FIG. 6 illustrates the power supply system in slave Panel with battery backup for computer CPU, touch screen, push buttons, light indication, radio links and PLC.

A two-way radio link (wireless) or two wire system or fiber optic communications link is often necessary to permit a response to a communication initiated from another location. A control system include a programmable logic controller (PLC) which includes various elements, that are often either sensors for providing inputs to the PLC or relays for receiving output from the PLC each under the control of an element controller and each connected to the PLC over a network for rapid execution by the three main steps executed repeatedly by the (a) The accruing of the status of each input to the PLC needed to execute ladder logic for the process being controlled.
(b) The solving of the ladder logic to determine each output.
(c) The updating of the status of the output.

The term "ladder" is used as the expression of the control logic is actually in the form a ladder, with each rung of the ladder having an output i.e. a value for the required state of a control element i.e. value corresponding to signals from monitoring elements. Programmable Logic Controller (PLC's) is relatively recent development in process control technology.

A PLC is used to monitor input/output events and conditions occurring in a controlled process. For example, a PLC can monitor such input conditions as pressure, flow rate and the like. A control program is stored in a memory within the PLC to instruct the PLC what actions to take upon encountering particular input signals or conditions. In response to these input signals provided by input reasons, the PLC drives and generates output signal which are transmitted via PLC output points to various output devices such as hydraulic valves to control their operating pressure. This approach to data transfer permits the network to rapidly and efficiently handle large communications volumes without reducing transfer speed.

The Subject application is a mere statement of invention, where many alternations and modification are possible without deviating from the scope of the invention. The subject disclosure is for illustrative purposes only, hence the same should not be construed to restrict the scope of the invention.

I claim:

1. In a device controlling an accumulator unit which controls a blow out preventer in a well drilling operation, the accumulator unit having selector valves with open/close positions, the improvements of the device comprising:

a master control panel for connection to the accumulator unit, acquisition of data and processing of the data, the master control panel comprising a master input module, a master output module and an analog input module;

slave panels respectively comprising slave input modules and slave output modules, the slave panels being programmable logic controllers for controlling the open/close positions of the selector valves of the accumulator unit; and connecting means for connecting the master control panel to the slave panels, the connecting means comprising a wireless modem.

2. The device according to claim 1, wherein the master input module is connected to at least one amplifier for amplifying thereto signals received from at least one proximity sensor for sensing the open/close positions of at least one of the selector valves.

3. The device according to claim 2, wherein the amplifier is triggered by the signals received from the proximity sensor.

4. The device according to claim 2, wherein the master output module is connected to a solenoid through at least one relay, the solenoid controlling an air cylinder that actuates the open/close positions of the at least one of the selector valves.

5. The device according to claim 4, wherein the analog input module is connected to at least one pressure transducer for sending a signal corresponding to a hydraulic pressure to the analog input module.

6. The device according to claim 5, wherein the hydraulic pressure is an accumulator pressure, manifold pressure, annular pressure or combination of at least two thereof.

7. The device according to claim 5, wherein at least one of the slave panels has a push button for providing input of a user.

8. The device according to claim 7, wherein at least one of the slave panels has a light indication in event of at least one of hydraulic pressure or level of hydraulic fluid falling below a predetermined value or failure of the at least one of the selector valves.

9. The device according to claim 8, wherein at least one of the slave panels is provided with a touch screen for entering user input and displaying data.

10. The device according to claim 9, wherein a wireless link of the wireless modem connects the master control panel directly to at least one of the slave panels.

11. The device according to claim 2, wherein a wireless link of the wireless modem connects the master control panel to at least one of the slave panels.

12. The device according to claim 1, wherein the master output module is connected to at least one relay pneumatically controlling the open/close positions of at least one of the selector valves.

13. The device according to claim 12, wherein a wireless link of the wireless modem connects the master control panel to at least one of the slave panels.

14. The device according to claim 1, wherein the analog input module is connected to at least one pressure transducer for sending a signal corresponding to a hydraulic pressure to the analog input module.

15. The device according to claim 14, wherein the hydraulic pressure is accumulator pressure or manifold pressure or annular pressure or a combination thereof.

16. The device according to claim 14, wherein a wireless link of the wireless modem connects the master control panel to at least one of the slave panels.

17. The device according to claim 1, wherein at least one of the slave panels has the slave input module connected to a push button for providing input of a user.

18. The device according to claim 1, wherein at least one of the slave panels has a glowing light indication in event of at least one of hydraulic pressure or level of hydraulic fluid falling below predetermined value or failure of at least one of the selector valves.

19. The device according to claim 1, wherein at least one of the slave panels is provided with a touch screen to display the data.

20. The device according to claim 1, wherein a wireless link of the wireless modem connects the master control panel to at least one of the slave panels.

* * * * *